US007490733B2

(12) United States Patent
Tagliareni

(10) Patent No.: US 7,490,733 B2
(45) Date of Patent: Feb. 17, 2009

(54) DISPENSER ASSEMBLY

(76) Inventor: Daria Tagliareni, 102 Pitney Ave., Spring Lake, NJ (US) 07762

( * ) Notice: Subject to any disclaimer, the term of this patent is extended or adjusted under 35 U.S.C. 154(b) by 220 days.

(21) Appl. No.: 11/332,522

(22) Filed: Jan. 13, 2006

(65) Prior Publication Data

US 2006/0157496 A1 Jul. 20, 2006

Related U.S. Application Data

(60) Provisional application No. 60/644,949, filed on Jan. 19, 2005.

(51) Int. Cl.
*B65H 1/00* (2006.01)

(52) U.S. Cl. ..... 221/46; 221/45; 221/49; 221/61; 221/62

(58) Field of Classification Search ..... 221/49, 221/45, 46, 62, 61
See application file for complete search history.

(56) References Cited

U.S. PATENT DOCUMENTS 3,141,569 A * 7/1964 Hanson ..... 221/34
3,568,884 A * 3/1971 Petricek, Sr. ..... 221/310
3,628,691 A * 12/1971 Hillman ..... 221/45
3,982,659 A * 9/1976 Ross ..... 221/63
5,346,064 A * 9/1994 Rizzuto ..... 221/63
5,803,346 A * 9/1998 Baker et al. ..... 229/117.3
6,189,730 B1 * 2/2001 McClymonds ..... 221/46
6,431,360 B1 * 8/2002 Julius ..... 221/46
6,520,371 B2 * 2/2003 Cheng ..... 221/33
7,252,209 B2 * 8/2007 Julius ..... 221/33

OTHER PUBLICATIONS

Derwent 2002359011, S.G. Kim.*

* cited by examiner

*Primary Examiner*—Gene Crawford
*Assistant Examiner*—Timothy R Waggoner
(74) *Attorney, Agent, or Firm*—Patterson & Sheridan; Keith Taboada

(57) ABSTRACT

The present invention generally provides a dispenser assembly which houses a disposable container of consumer product. The dispenser assembly improves an aperture that allows access to the product from the exterior of the dispenser assembly. In one embodiment, the disposable container of consumer product is configured to engage with the dispenser assembly in a manner that retains a portion of the container through which the product is dispensed in a pre-defined orientation relative to the cover of the dispenser assembly. In one embodiment, a neck of the container of consumer product through which the product may be accessed engages the aperture of the dispenser assembly to selectively retain the container and the dispenser assembly. In one embodiment, the neck is snap-fit into the aperture.

19 Claims, 8 Drawing Sheets

DISPENSER ASSEMBLY

CROSS-REFERENCE TO RELATED APPLICATION

This application claims benefit of U.S. Provisional Application Ser. No. 60/644,949, entitled "DISPENSER ASSEMBLY", filed Jan. 19, 2005, which is hereby incorporated by reference in its entirety.

BACKGROUND OF THE INVENTION

1. Field of the Invention

Embodiments of the present invention generally relate to a dispenser assembly, and more specifically, to a dispenser assembly for retaining a replaceable container of consumer goods, for example, wipes, facial tissue, toilet papers and napkins, among others.

2. Background of the Invention

Dispenser assemblies for consumer goods, such as wipes, facial tissue, toilet paper, napkins, and the like, are often placed on a horizontal surface where they are free to slide or mounted securely to a vertical surface. Dispenser assemblies that are placed on horizontal surfaces are often misplaced or are stored in an area not readily available for use when the product disposed inside the dispenser is needed. Dispenser assemblies mounted to vertical structures often are bulky and not aesthetically pleasing.

Therefore, there is a need for an improved dispenser assembly.

SUMMARY OF THE INVENTION

The present invention generally provides a dispenser assembly that houses a disposable container of consumer product. The dispenser assembly includes an aperture that allows access to the product from the exterior of the dispenser assembly. In one embodiment, the disposable container of consumer product is configured to engage the dispenser assembly in a manner that retains a portion of the container in a pre-defined orientation relative to a cover of the dispenser assembly. In another embodiment, a neck of the container through which the product may be accessed, engages an aperture of the dispenser assembly to selectively secure the container to the dispenser assembly. In another embodiment, the neck is snap-fit into the aperture.

BRIEF DESCRIPTION OF THE DRAWINGS

The accompanying drawings, which are incorporated in and constitute a part of the specification, schematically illustrate the present invention, and together with the general description given above and the detailed description given below, serve to explain the principles of the invention.

It is to be noted, however, that the appended drawings illustrate only typical embodiments of this invention and are therefore not to be considered limiting of its scope, for the invention may admit to other equally effective embodiments. It is also contemplated that features of one embodiment may be beneficially incorporated in other embodiments, including those not explicitly described, without a specific description of the combined embodiment.

DETAILED DESCRIPTION

Figure 1:
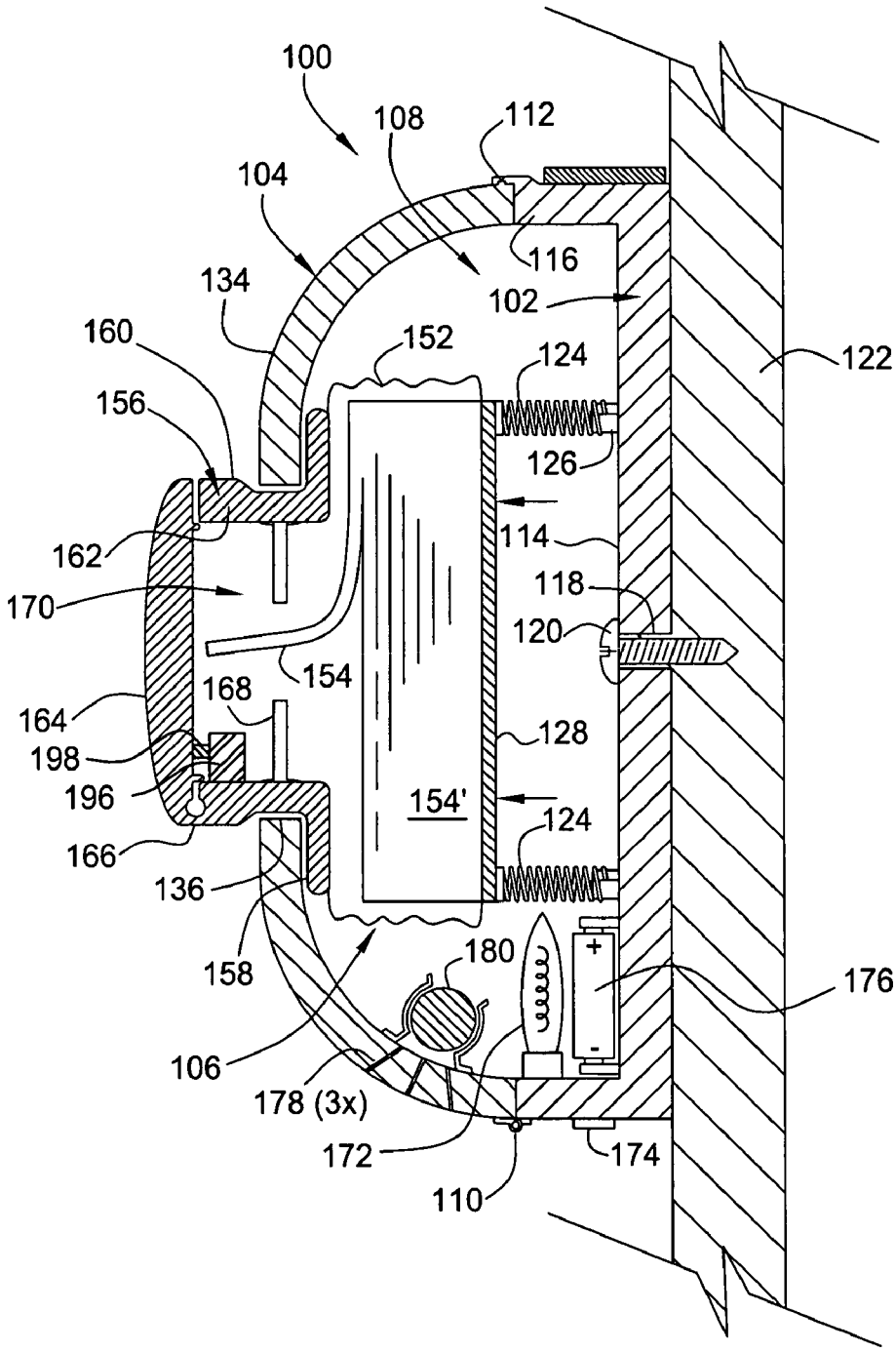
FIG. 1 is a side sectional view of one embodiment of a dispenser assembly.

FIG. 1 depicts one embodiment of a dispenser assembly 100. The dispenser assembly 100 includes a base 102 and a cover 104, which together define an interior volume 108 adapted to retain a replaceable container 106 having consumer product 154' disposed therein. The cover 104 may be selectively separated from the base 102 to facilitate replacement of the container 106.

In the embodiment depicted in FIG. 1, the cover 104 is coupled to the base 102 by a hinge 110. Although the hinge 110 is shown as a separate element coupling the cover 104 to the base 102, the hinge 110 may be an integral part of the cover 104 and base 102, for example, as a living hinge in embodiments where the base 102 and cover 104 are molded as a single component. When the dispenser assembly 100 is closed, a latch 112, or other suitable mechanism, secures the cover 104 to the base 102. It is contemplated that the cover 104 may be removably secured to the base 102 in alternative manners, for example, by mating geometry, snap fit, a bayonette configuration, threaded engagement, removable adhesive, fasteners, clips, springs or other suitable arrangement for retaining the cover 104 to the base 102. Embodiments having removable covers allow covers to be interchanged with the mounted base, thus allowing the cover to be changed to meet design and/or seasonal motifs.

The base 102 may be fabricated from any suitable material, such as plastic or metal, among others. In one embodiment, the base 102 includes a mounting plate 114 having a wall 116 extending from its outer portion. The distal end of the wall 116 generally abuts against the cover 104 when the dispenser assembly 100 is closed.

The mounting plate 114 is configured to facilitate attachment of the dispenser assembly 100 to a surface, such as a wall 122 of a structure. The mounting plate 114 may be coupled to the wall 122 by any suitable method. In the embodiment depicted in FIG. 1, the dispenser assembly 100 is coupled to the wall 122 by one or more fasteners 120 passing through respective holes 118 formed through the mounting plate 114. In the embodiment depicted in FIG. 1, only one fastener 120 is shown. It is also contemplated that the mounting plate 114 may include a recess or channel (not shown) to accommodate an adhesive strip (also not shown) for mounting the dispenser assembly 100 to a surface (e.g., the wall 122) in applications where use of a fastener is undesirable.

At least one spring 124 is disposed in the dispenser assembly 100 to bias the container 106 of consumer product toward the cover 104. In the embodiment depicted in FIG. 1, two springs 124 are shown coupled to the base 102. One end of each spring 124 is retained on a post 126 extending from the mounting plate 114. The other end of the springs 124 are coupled to a plate 128 such that the container 106 and/or contents therein (e.g., the consumer product 154') may be uniformly biased toward the cover 104.

The cover 104 may be fabricated from any suitable material, such as plastic or metal, among others. The cover 104 generally includes a top portion 134 having an aperture 136 formed therethrough. The aperture 136 facilitates access to the interior volume 108 of dispenser assembly 100, and in one embodiment, provides an attachment point for the replaced container 106.

The cover 104 may have any shape, such as a dome. It is also contemplated that the cover 104 may be fabricated in shapes, such as Christmas Trees or other motifs.

In one embodiment, the cover 104 fabricated from a clear or translucent material to allow the designer assembly 100 to incorporate a light. For example, a light 172 may be disposed in or coupled to the dispenser assembly 100 and activated by a switch 174. The light 172 may be powered by facility electric (i.e., hard wired) or by a battery 176 retained by the dispenser assembly 100.

The cover 104 and/or base 102 of the dispenser assembly 100 may additionally include one or more apertures 178 to allow an aerosol or fragrance to be dispensed from the dispenser assembly 100. For example, an aerosol solid 180 may be retained in the dispenser assembly 100 to provide a continuous supply of scent into the room. It is also contemplated that the dispenser assembly 100 may include a pump or apparatus for dispensing a fragrance from a replaceable container (not shown), such as a liquid or pressurized cartridge.

The replaceable container 106 generally includes a housing 152 coupled to a neck assembly 156 which defines a volume that retains the consumer product 154' therein. The housing 152 may be fabricated from a polymer or other suitable material, and in one embodiment, is a flexible, plastic bag. The neck assembly 156 is configured to allow a portion of the product, as shown by reference numeral 154, to pass therethrough, thereby facilitating dispense of the product 154' within the container 106.

The neck assembly 156 is typically fabricated from a polymer or other suitable material. The neck assembly 156 generally includes a flange 158 extending radially outward from a neck 162. The neck 162 defines a throat 170 through which product 154 is dispensed. The throat 170 may optionally include a baffle 168 or other suitable structure to position the product 154 in the throat 170 to facilitate consumer access to the product 154'.

The throat 170 is selectively closed by a cap 164. The cap 164 may be fabricated from any suitable material, such as a polymer or metal, among others. In the embodiment depicted in FIG. 1, the cap 164 is integrally molded as part of the neck assembly 156, being coupled to the neck 162 by a living hinge 166. It is also contemplated that the cap 162 may be a separate element from the neck assembly 156, such as a screw or snap-on-cap, or retained to the dispenser assembly 100 by a lanyard or other device.

In the embodiment depicted in FIG. 1, the container 106 is selectively retained to the dispenser assembly 100 by an engagement feature 160. The engagement feature 160 retains the container 106 in a pre-defined position relative to the cover 104 to ensure ease of access to the product by consumers.

In the embodiment depicted in FIG. 1, the engagement feature 160 extends outward from the neck 162 to retain at least a portion of the aperture 136 between the engagement feature 160 and the flange 158. Thus, in this embodiment, at least a portion of the aperture 136 can also be considered an engagement of the dispenser assembly 100. It is also contemplated that other configurations for engagement features suitable for retaining the container 106 to the dispenser assembly 100 may be utilized. For example, the engagement feature may be a spring clip (302 in FIG. 3), a latch (304 in FIG. 3), a bayonet arrangement, a keyed feature, a hole for a pin or a fastener, a threaded region for engagement with the cover 104 or other configuration suitable for retaining the container 106 to the dispenser assembly 100. It is contemplated that the engagement features may be defined on at least one of the container 106, the cover 102 or the base 104.

Figure 2:
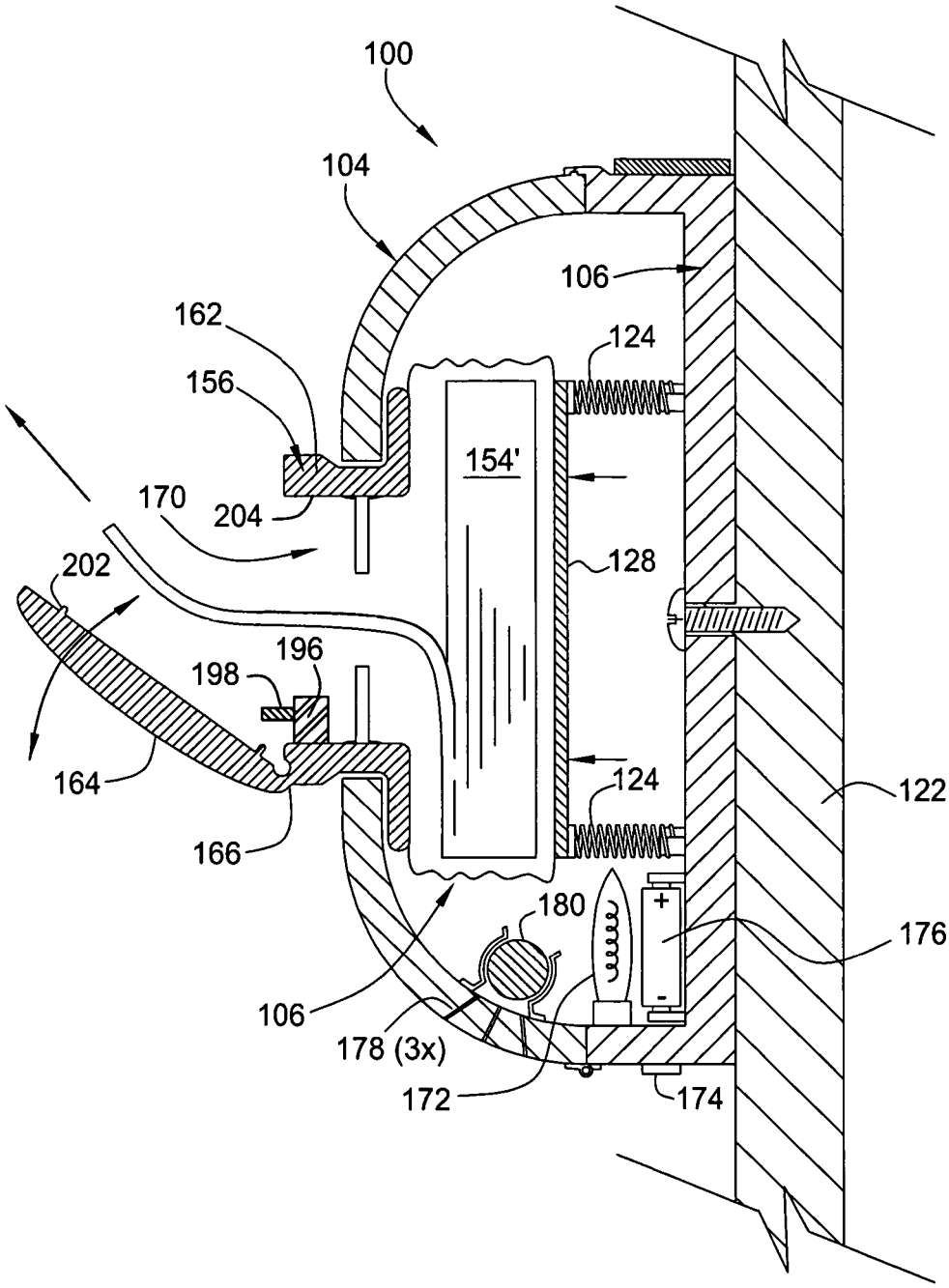
FIGS. 2-3 are side sectional views of the dispenser assembly of FIG. 1 in different modes of operation.

FIG. 2 depicts one mode of operation of the dispenser assembly 100. In the embodiment depicted in FIG. 2, the cap 164 is rotated about the hinge 166 to open the throat 170 of the neck assembly 156 to allow product 154 to be accessed and dispensed. The cap 164 may also include a feature such as a lip 202 which engages the inner wall 204 of the neck 162 to selectively retain the cap 164 in the closed position as shown in FIG. 1. As the product 154 is removed from the container 106, the one or more springs 124 urge the remaining product 154' disposed in the container 106 toward the throat 170. Thus, as the product 154 remains disposed against the neck assembly 156, the product remains readily accessible to the consumer.

An audio player 198 may be coupled to the neck assembly 106 and/or cover 104 and/or base 102. The audio player 198 includes a switch 196 which senses the open and closed position of the cap 164. When the cap 164 is opened, the switch 196 activates the audio player 198 so that a pre-recorded message or music is played by the player 198. The message or music may be contained in a replaceable memory device, such that the recorded audio file may be selectively replaced, such that the music or message played by the audio player 198 may be periodically changed. In one embodiment, the audio player 198 includes an application specific processor, memory, a battery and a speaker, all not shown.

Figure 3:
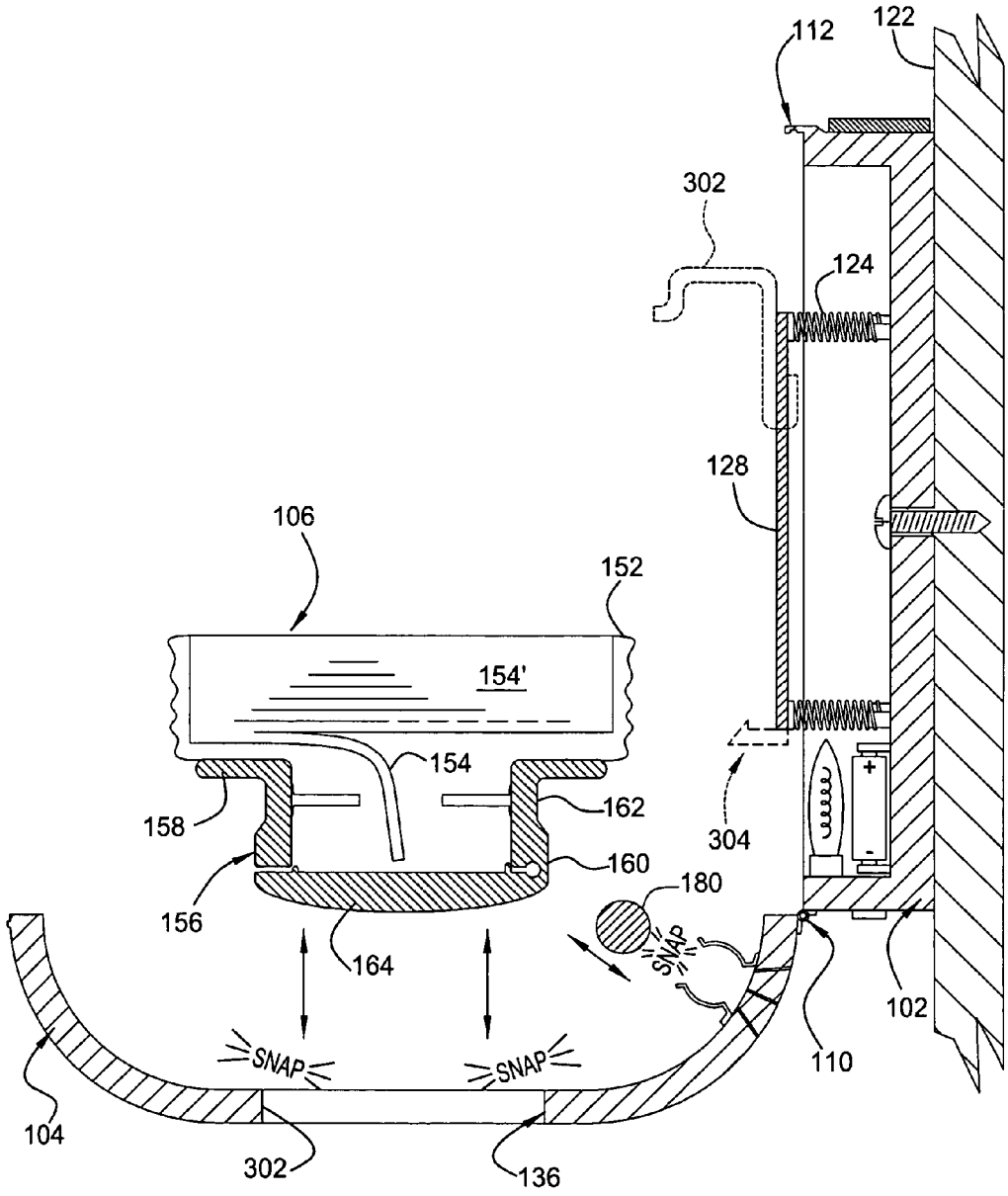

FIG. 3 depicts another mode of operation of the dispenser assembly 100. In the embodiment depicted in FIG. 3, the cover 104 of the dispenser assembly 100 is shown in an open position to facilitate replacement of the container 106 of consumer product. In the embodiment depicted in FIG. 3, a portion of the neck assembly 156 may be disposed through the aperture 136 of the cover 104 such that the engagement feature 160 snaps over the side walls 302 of the aperture 136, thus capturing the cover 104 between the flange 158 and engagement feature 160. In this manner, the replaceable container 106 may be selectively engaged and retained to the dispenser assembly. The container 106 may be removed in a similar manner.

Figure 4:
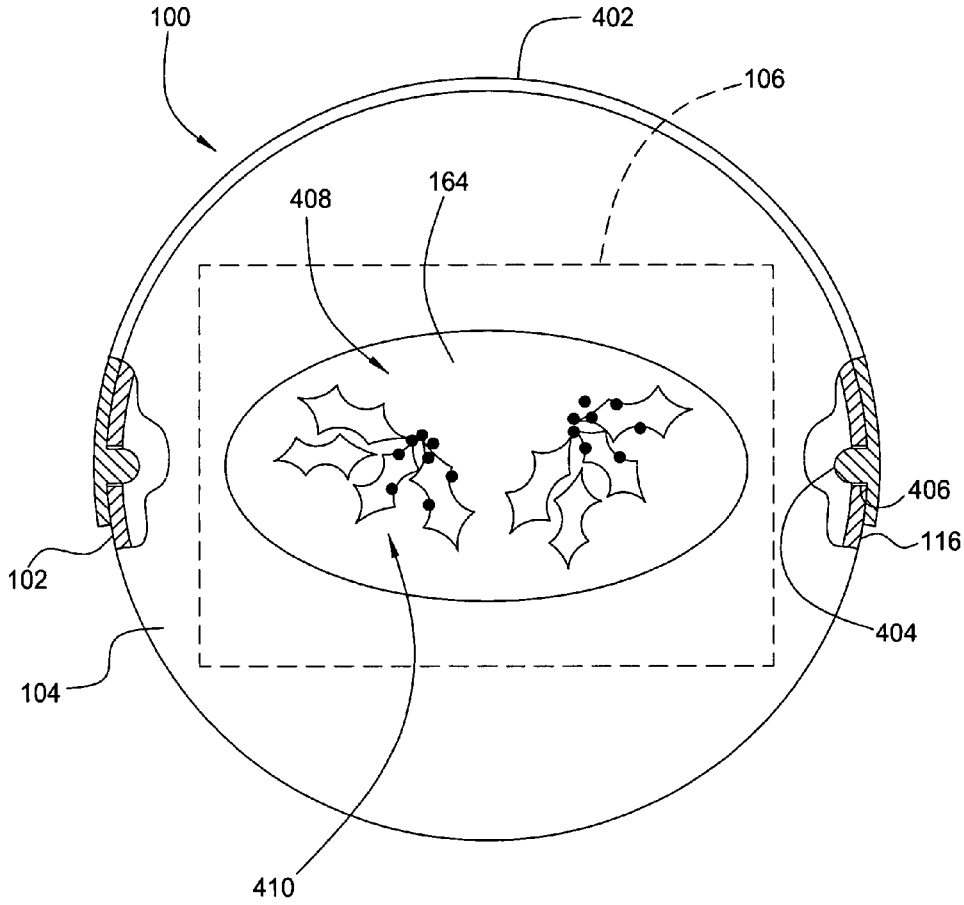
FIG. 4 is a front elevation of the dispenser assembly of FIG. 1.

FIG. 4 is a front view of the dispenser assembly 100. As the cap 164 of the replaceable container 106 extends through and/or is visible through the aperture 136 of the cover 104, a face 408 of the cap 164 may include a design 410 to augment the aesthetics of the dispenser assembly 100. The design 410 may be embossed, integrally molded, screen printed or adhered to the face 408 or ornate the face 408 in another manner. It is contemplated that the design 410 may have a seasonal or other significance, such that the design 410 appearing on the replaceable container 106 may be selected to coincide with a holiday or other event. It is also contemplated that the design 410 may include text or designs of other significance. For example, the design 410 may include art work or characters such as comic, children's storybook and/or movie characters, and the like, which may be appealing to children or other target group. Such designs may promote the child's interest and acceptance of the dispenser 100, and therefore are more apt to use the consumer product 154' stored inside.

Figure 5:
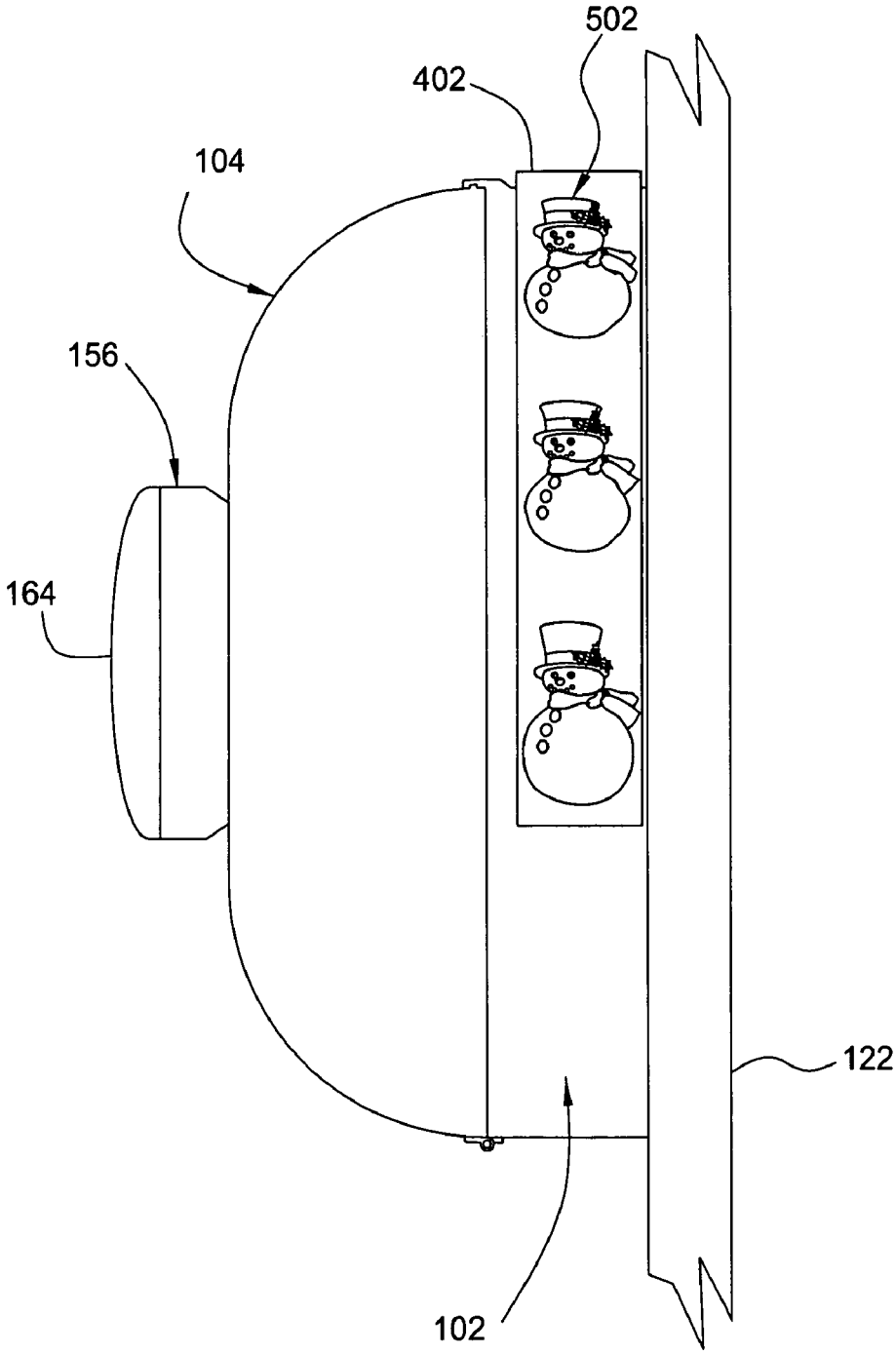
FIG. 5 is side view of the dispenser assembly of FIG. 1.

The dispenser assembly 100 may include a trim band 402. The trim band 402 may be coupled to the base 102 and/or the cover 104. The trim band 402 may be a decal, or removable element, such as a plastic or metal strip. In the embodiment depicted in FIG. 4, the trim band 402 includes a pin 404 configured to engage a hole 406 formed in the base 102 of the dispenser assembly 100. The pin 404 releasably secures the band 402 to the dispenser assembly 100, and thus, the band 402 may be readily replaced with other bands to selectively change the appearance of the dispenser assembly 100. For example, in the embodiment depicted in FIG. 5, the trim band 402 includes a design 502. The design 502 may be selected as described with reference to the design 410 described above. Alternatively, the trim band 402 may have a solid color, pattern and/or be textured.

In another embodiment, the trim band 402 may be imprinted or otherwise display text. The text may be anecdotal, or include instruction for use of the consumer product inside the dispenser assembly 100.

Figure 6:
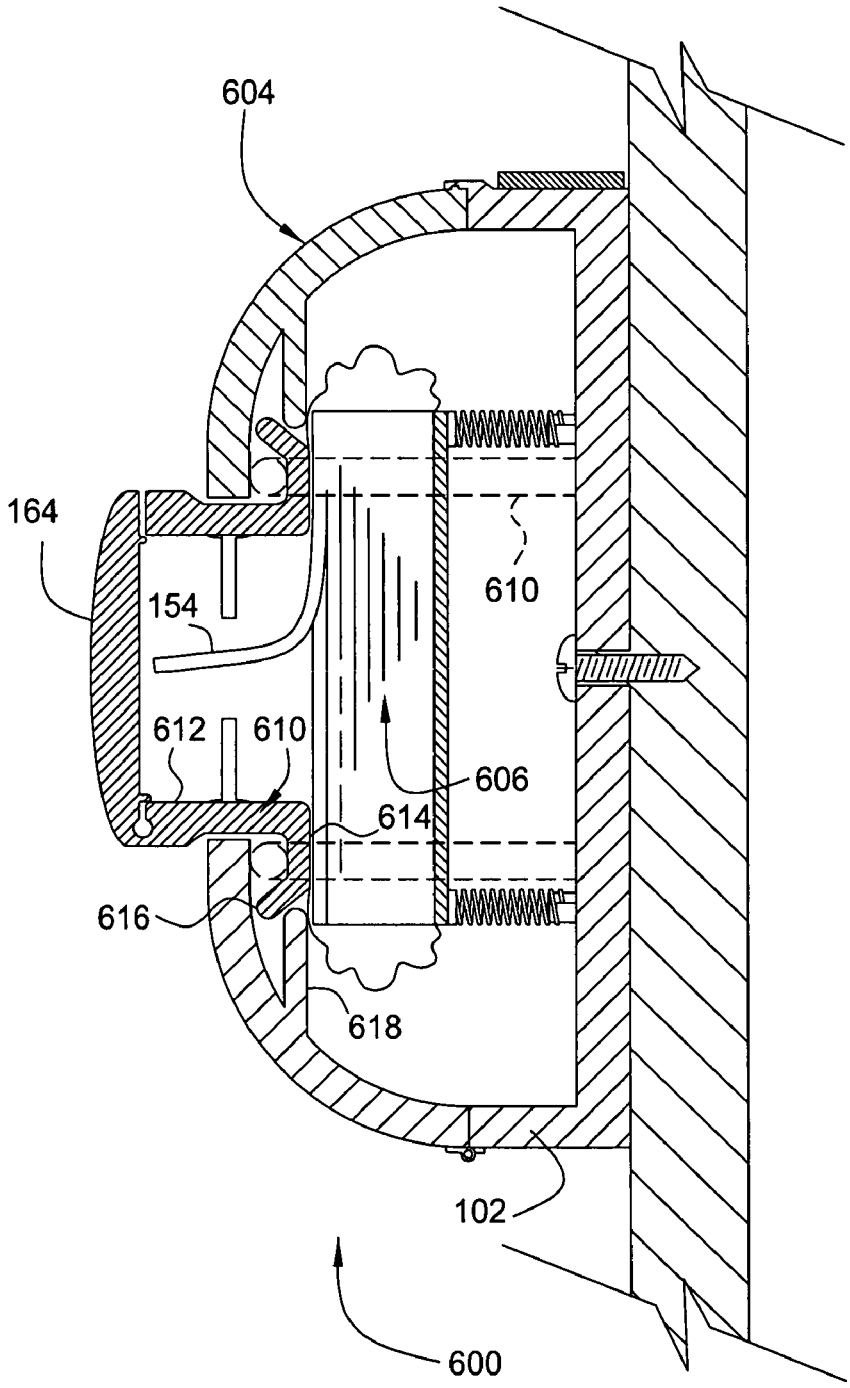
FIG. 6 is a partial sectional view of another embodiment of a dispenser assembly illustrating one alternative arrangement for releasably securing a disposable container of consumer product to the dispenser assembly.

As discussed above, it is also contemplated that the replaceable container of product may be releasably coupled to a dispenser assembly in any suitable manner. For example, a dispenser assembly 600 depicted in FIG. 6 includes a cover 604 that has an engagement feature 618 extending inward therefrom. The engagement feature 618 mates with an engagement feature 616 formed on a neck assembly 610 of a replaceable container 606 disposed in the dispenser assembly 600. The engagement features 618 and 616 may interlock in any manner suitable for releasably retaining the container 606 in the dispenser assembly 600, for example, snap-fit, bayonet, quarter turn, threaded engagement or press-fit, among others. Thus, the neck 612 of the dispenser of the container 606 is selectively retained in a pre-defined orientation relative to the cover 604 of the dispenser assembly 600 to facilitate ease of access to the product. Alternatively, the engagement feature may be an elastic cord or a strap 610 (shown in phantom) coupled to at least one of the cover 104 or base 102 to retain the container 106.

Figure 7:
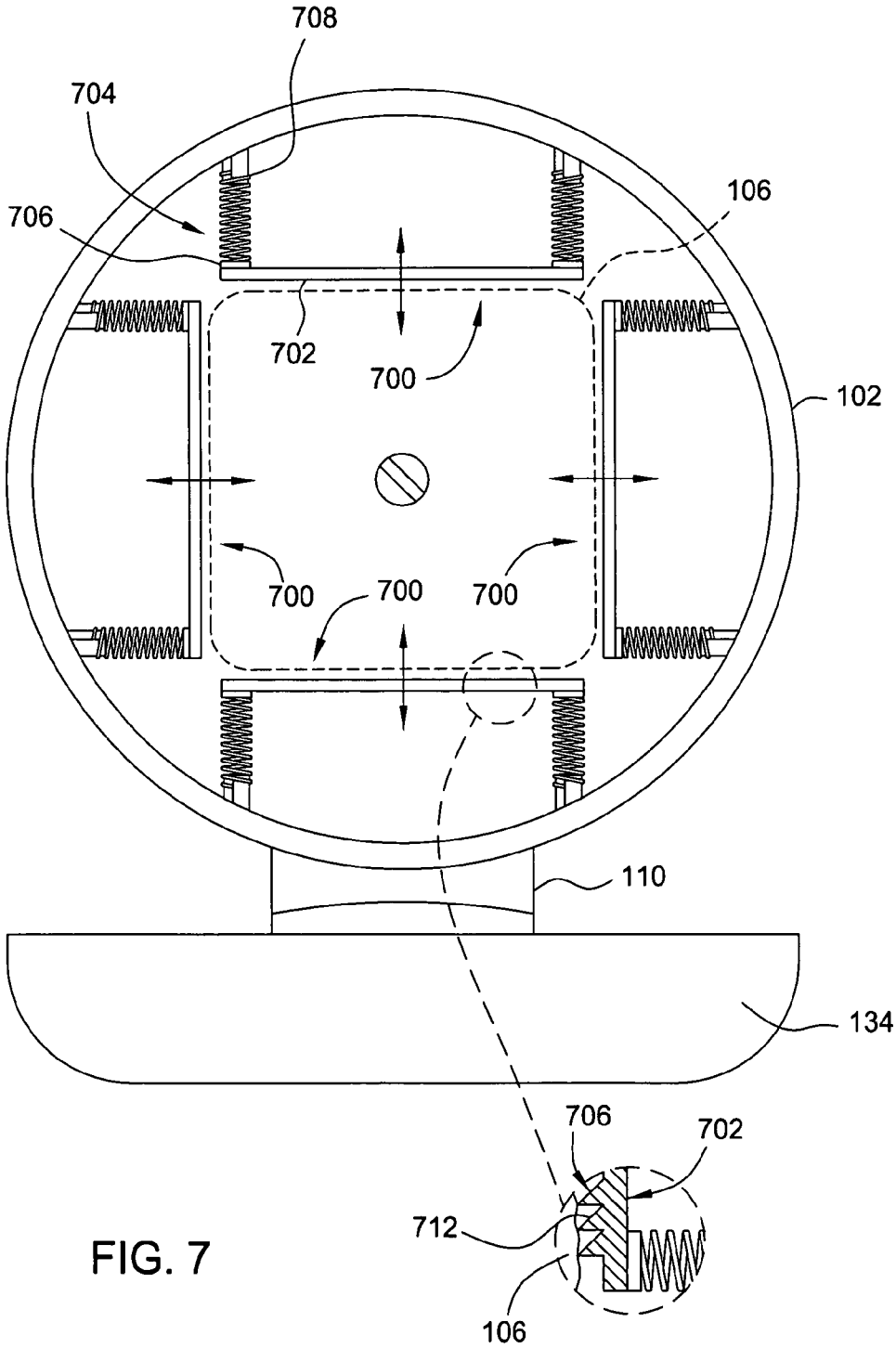
FIG. 7 is a front elevation of the dispenser assembly of FIG. 1.

FIG. 7 depicts a frontal view of one embodiment of the dispenser assembly 100. The dispenser assembly 100 includes a plurality of adapters 700 which are utilized to center and/or secure the replaceable consumer product 106 in the base 102. In the embodiment depicted in FIG. 7, four adapters 700 are shown which are adapted to bias the sides of the consumer product 106 toward the center of the base 102, thereby positioning the container 106 relative to the aperture formed through the cover 102. In the embodiment shown, each adapter 700 is decoupled from the adjacent adapters 700 such that consumer product container 106, having square, rectangular, circular or other geometric profile, may be centered and/or retained in the base 102 without modification.

In one embodiment, the adapter 700 includes an elongated strip 702 biased from the sides of the base 102 by at least one spring 704. Spring 704 may be a coil or flat spring form. In the embodiment depicted in FIG. 7, the elongated strap 702 and base 102 include a plurality of bosses 706, 708 extending therefrom, which capture the respective ends of the spring 704, thereby retaining the strip 702 to the base 102.

Optionally, the adapter 700 may include an engagement feature 710 configured to retain the consumer product container 106 to the base 102. The engagement feature 710 may be utilized in conjunction with, or as an alternative to, the engagement feature 160. In the embodiment depicted in FIG. 7, the engagement feature 710 is in the form of a plurality of barbs 712.

Figure 8C:
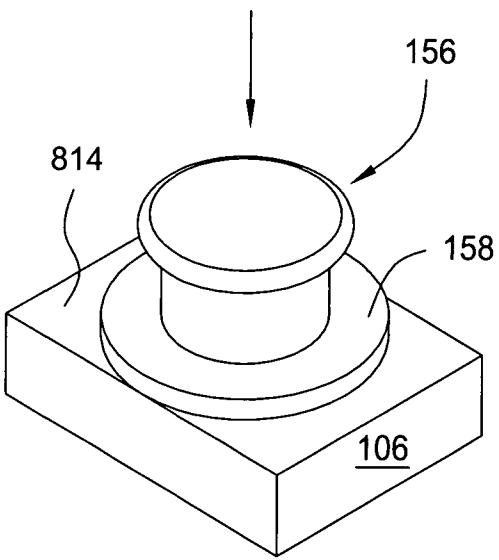
FIGS. 8A-C are perspective views of a sequence illustrating installation of a neck assembly to a container of consumer product.
Figure 8B:
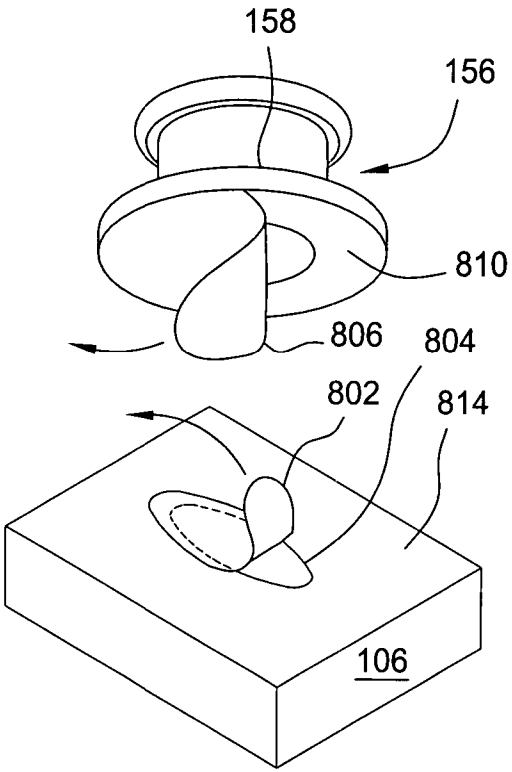
Figure 8A:
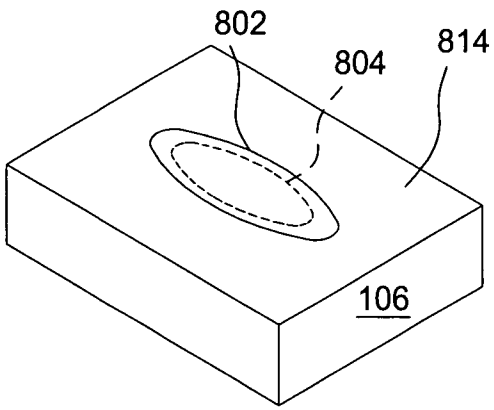

FIGS. 8A-8C depict one embodiment of a sequence of coupling the neck assembly 156 to the replaceable container 106. As shown in FIG. 8A, the replaceable container 106 typically includes an aperture 804 through which the consumer product 154' is accessed. The aperture 804 is sealed by a removable strip 802. The strip 802 is removed from a first side 814 of the container 106, for example, by peeling the strip from the container 106 as shown in FIG. 8B. The neck assembly 156 generally includes an adhesive 810 disposed on an underside of the flange 158. A backing 808 is peeled away to expose the adhesive layer 810. The neck assembly 156 is then pressed against the first side 814 of the container 106 over the aperture 804, such that the adhesive 810, exposed on the flange 158, secures the neck assembly 156 to the replaceable container 106 over the aperture 804. It is contemplated that the neck assembly 156 may be secured to the container 106 by other methods.

Although the dispenser assembly described above depicts a generally round dispenser assembly and oblong caps of the replaceable containers of consumer product disposed therein, it is contemplated that any geometric form may be utilized for both the container of consumer product and the dispenser assembly. It is also contemplated that features of the neck assembly may be incorporated into the cover, such that only the consumer product needs to be replenished as opposed to an entire container.

Thus, a dispenser assembly suitable for retaining a replaceable container of consumer product has been provided. The dispenser assembly advantageously facilitates dispensing of the consumer product while facilitating ease of replacement of the container within the dispenser assembly. Moreover, the design features of both the dispenser assembly and the cap of the replaceable container may include designs which enhance the aesthetic appeal of the dispenser assembly while encouraging children to use the product stored inside.

The present invention has been described in terms of a preferred embodiment. The invention, however, is not limited to the embodiment depicted and described. Rather, the scope of the invention is defined by the appended claims.

What is claimed is:

1. A dispenser assembly for housing a disposable finished container of consumer product comprising:

a base;

a cover removably coupled to the base and defining a volume therebetween sufficient to house the finished container of consumer product;

an aperture formed in the cover suitable for accessing the finished consumer product housed in the volume;

a neck assembly separately attachable to the finished container of consumer product, the neck assembly comprising a throat formed through the neck assembly and configured to allow product to be dispensed from the container and a cap selectively closing the throat; and an engagement feature configured to secure the neck assembly retaining the finished container of consumer product to cover, wherein the engagement feature is the aperture formed in the cover.

2. The dispenser assembly of claim 1 further comprising:

a hinge coupling the base to the cover.

3. The dispenser assembly of claim 1 further comprising:

a light coupled to at least one of the cover or base.

4. The dispenser assembly of claim 1 further comprising:

a mounting bracket coupled to at least one of the cover or base and adapted to retain a scent container.

5. The dispenser assembly of claim 4, wherein at least one of the cover or base further comprises:

a plurality of apertures formed through at least one of the housing or base approximate to the mounting bracket.

6. The dispenser assembly of claim 1, wherein the base further comprises:

at least one mounting hole formed therethrough.

7. The dispenser assembly of claim 1 further comprising:

at least one adapter disposed in the volume and adapted to position the container of consumer product relative to the aperture.

8. The dispenser assembly of claim 1 further comprising:

a plurality of adapters coupled to the base and adapted to position the consumer product relative to the aperture formed through the cover.

9. The dispenser assembly of claim 7, wherein the adapter further comprises an engagement feature.

10. The dispenser assembly of claim 1, wherein the engagement feature further comprises:

a spring clip or latch.

11. The dispenser assembly of claim 1, wherein the engagement feature further comprises:

a strap or an elastic cord.

12. The dispenser assembly of claim 1, wherein the engagement feature further comprises:

at least one of a barb configured to engage the container of consumer product.

13. The dispenser assembly of claim 1, wherein the aperture is configured to snap fit with the neck assembly, and wherein the neck assembly is attached to the container of consumer product.

14. The dispenser assembly of claim 1, wherein the engagement feature of the cover further comprises: at least one of a spring clip, a latch, a bayonet arrangement, a keyed feature, a hole for a pin or a fastener, or a threaded region.

15. The dispenser assembly of claim 1 further comprising:

a decorative band removeably affixable to at least one of the cover or base.

16. A dispenser assembly for dispensing consumer product comprising:

a base;

a cover removeably coupled to the base;

a replaceable finished container of consumer product disposed in a volume at least partially bounded by the cover and base;

an aperture formed in the cover suitable for accessing the consumer product disposed in the finished container of consumer product;

a neck assembly coupled to the finished container of consumer product, the neck assembly having a neck extending through the aperture, wherein the neck assembly further comprises a throat formed through the neck of the neck assembly and configured to allow product to be dispensed from the container, and a cap selectively closing the throat; and an engagement feature integral with the cover configured to mate with the neck of the neck assembly by a snap fit.

17. The dispenser assembly of claim 16, wherein the neck assembly snap-fits in the aperture.

18. A neck assembly for interfacing with dispenser assembly and a finished container of consumer product, the neck assembly comprising:

a neck having a throat formed therethrough;

a flange extending outward from a first end of the end;

a pressure sensitive adhesive disposed on the flange, wherein the adhesive circumscribes a passage defined through the throat;

a backing covering the pressure sensitive adhesive and removable therefrom to exposed the pressure sensitive adhesive for coupling the flange to the finished container of consumer product; and a cap selectively closing the throat.

19. The neck assembly of claim 18, further comprising:

an engagement feature extending from an exterior of the neck opposite the flange, the engagement feature configured to engage with and retain the neck assembly to the dispenser assembly via a snap fit.

* * * * *